US006318835B2

(12) United States Patent
Nakahara

(10) Patent No.: US 6,318,835 B2
(45) **Date of Patent: *Nov. 20, 2001**

(54) INK-JET PRINTER WITH MAINTENANCE MECHANISM

(75) Inventor: Junji Nakahara, Nagoya (JP)

(73) Assignee: Brother Kogyo Kabushiki Kaisha, Nagoya (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/036,779

(22) Filed: Mar. 9, 1998

Related U.S. Application Data

(63) Continuation-in-part of application No. 08/747,387, filed on Nov. 12, 1996, now Pat. No. 5,988,789.

(30) Foreign Application Priority Data

Nov. 20, 1995 (JP) ..... 7-326604
Mar. 10, 1997 (JP) ..... 9-054330

(51) Int. Cl.[7] ..... B41J 2/165
(52) U.S. Cl. ..... 347/30; 347/23; 347/33
(58) Field of Search ..... 347/30, 33, 32, 347/23, 24

(56) References Cited

U.S. PATENT DOCUMENTS 5,115,250 * 5/1992 Harmon et al. ..... 347/33
5,437,444 8/1995 Kawakami et al. .
5,523,848 * 6/1996 Musso et al. ..... 358/296
5,639,220 * 6/1997 Hayakawa ..... 347/53
5,831,644 * 11/1998 Kato ..... 347/22
5,889,536 * 3/1999 Sasaki ..... 347/30
5,896,143 * 4/1999 Matsui et al. ..... 347/33
5,926,193 * 7/1999 Umeda ..... 347/30
6,007,179 * 12/1999 Ohtani et al. ..... 347/30
6,024,435 * 2/2000 Muraki ..... 347/32
6,132,027 10/2000 Suzuki et al. ..... 347/33

FOREIGN PATENT DOCUMENTS 0 630 754 A2 12/1994 (EP) .
A-62-263058 11/1987 (JP) .
3005181 1/1991 (JP) .
3136858 6/1991 (JP) .
7025026 1/1995 (JP) .

* cited by examiner

*Primary Examiner*—Judy Nguyen
*Assistant Examiner*—Shih-Wen Hsieh
(74) *Attorney, Agent, or Firm*—Oliff & Berridge, PLC

(57) ABSTRACT

An ink-jet printer with a maintenance mechanism uses a single cam to clean and maintain a recording head. The cam is driven by a paper-feed motor in the forward direction during the maintenance operations. When the recording head is disposed in a maintenance area, the driving force of the paper-feed motor is transferred to the cam via a coupler. In one revolution of the cam, a suction cap, a suction pump, and a wiper are driven at a predetermined timing to clean the recording head. The paper-feed motor is also used to drive the platen roller during the recording operation. Because a common motor is used to drive the platen roller and the cam, and because a single cam completes the maintenance operations in one revolution, the structure and its control are simplified.

25 Claims, 15 Drawing Sheets

6°
54
52A
42
52
53
43
52B

57°
54
52A
52B
53
43

43
97°
54
52A
52B
53

43
114°
52A
122°
52B
54
53

129°
54
52A
135°
53
145°
52B
52E
43

171°
54
52A
179°
53
52B 43
205°
54
52A
53
52B
52E

211°
221°
239°
253°
263°
269°
290°
43
41
5
49

INK-JET PRINTER WITH MAINTENANCE MECHANISM

This application is a continuation-in-part application of the U.S. patent application Ser. No. 08/747,387 filed on Nov. 12, 1996, now U.S. Pat. No. 5,988,789.

BACKGROUND OF THE INVENTION

1. Field of the Invention

This invention generally relates to an ink-jet printer, and more particularly, to an ink-jet printer having a maintenance mechanism for preventing a malfunction of a recording head of the ink-jet printer.

2. Description of the Related Art

Conventionally, many types of ink-jet printers having cleaning mechanisms have been known. In such ink-jet printers, ink drops are ejected from nozzles of a recording head toward a recording medium, which is being transported by a transporting device (e.g., platen roller). When the recording head is not in use (that is, when the printing operation is not performed), the nozzle surface of the recording head is covered with a suction cap, and the ink remaining in the recording head is sucked out by a suction pump via the suction cap. The nozzle surface is subsequently wiped by a wiper to keep the recording head clean.

U.S. Pat. No. 5,138,343 discloses an ink-jet printer as discussed above. In general, the suction cap is moved toward, and drawn back from, a cleaning position by a carriage-driving motor and an associated cam. The suction pump is activated by a paper-feed motor and another cam. Thus, the actions of the suction cap and the suction pump are controlled separately using different driving power sources. The wiper is always positioned at the cleaning position on the sliding path of the carriage.

Because the suction cap and the suction pump are activated by separate cams and motors in the conventional ink-jet printers, the structure and control of the cleaning mechanism are complicated.

SUMMARY OF THE INVENTION

This invention was conceived to overcome the problems of the conventional art. Specifically, it is an object of the invention to provide an ink-jet printer with a maintenance mechanism, which has a simple structure and requires a simple control operation. In order to achieve this object, a paper-feed motor is used to activate not only the platen roller but also the suction cap, the suction pump, and the wiper to clean the recording head.

The ink-jet printer with a maintenance mechanism according to the invention comprises a recording-medium transporter for transporting a recording medium, a driving unit for driving the recording-medium transporter, and a recording head having a nozzle surface in which a plurality of nozzles are provided to eject ink drops. The ink-jet printer also has a suction cap for covering the nozzle surface, a suction pump for sucking ink out of the recording head via the suction cap, and a wiper for wiping the nozzle surface of the recording head. A carriage holds the recording head. A lock secures the carriage at a predetermined position. The suction cap, the suction pump, and the wiper are driven by a cam which receives a driving force from the driving unit. A power connection/disconnection mechanism is provided to transfer the driving force of the driving unit to the cam and cut off the power transfer at a desired timing.

The ink-jet printer further comprises a shifting mechanism for moving the recording-head between a recording area, where the recording operation is performed on the recording medium, and a maintenance area, where the recording head is cleaned using the suction cap, the suction pump, and the wiper. The power connection/disconnection mechanism has a coupler. When the recording head enters the maintenance area, the coupler allows the driving force to be transferred from the driving unit to the cam to activate the suction cap, the suction pump, and the wiper.

The driving unit is a single driving motor. The recording-medium transporter is, for example, a platen roller. The cam is driven by the single driving motor in the forward direction.

The cam comprises a first cam surface for moving the suction cap and the wiper held on the associated holders forward toward, and backward from, the nozzle surface of the recording head, and a second cam surface for activating the suction pump.

The power connection/disconnection mechanism has a stepped gear that is movable along its gear shaft. The coupler has a first lever, a second lever, and a link coupling the first and second levers. The first lever contacts the carriage on which the recording head is mounted when the carriage moves to the maintenance area. The second lever causes the stepped gear to move along its gear shaft.

The suction pump comprises a first piston, a second piston, and a pump housing. The first and second pistons and the housing define a pump chamber. The volume of the pump chamber varies depending on the positions of the first and second pistons. The second cam surface of the cam has a groove for driving the first piston, and a groove for driving the second piston.

The cam also has a third cam surface that extends between the first and second cam surfaces. This third cam surface causes the lock to move between a locked position and an unlocked position.

Grooves are formed in the second cam surface so that the suction pump performs a first suction with a small vacuum and a second suction with a large vacuum in one revolution of the cam.

The cam is provided with grooves on the opposite surface. These groove are designed so that the suction cap is brought onto the nozzle surface to allow the ink to be sucked out of the recording head by the suction pump during the first suction, and the suction cap is gradually separated from the nozzle surface to discharge the ink from the suction cap by the suction pump during the second suction.

A cap holder for holding the suction cap also has a preservation cap for covering the nozzle surface of the recording head when the recording operation is not performed. A pivoting guide is provided to guide the preservation cap directly over the nozzles and seal the nozzle apertures.

In accordance with the ink-jet printer of the invention, the driving unit for driving the recording-medium transporter is also used to drive the cam for activating the suction cap, suction pump, and the wiper. This structure reduces the number of elements used in the ink-jet printer and, consequently, the entire cost can be reduced. In addition, by simply rotating the cam by one revolution, a maintenance cycle is completed by the suction cap, the suction pump, and the wiper. Because the cam is rotated in only one direction (i.e., in the forward direction), it is not necessary to consider backlash.

When the recording head is slid from the recording area to the maintenance area, the driving unit is connected to the cam via a gear train which meshes via the coupler. Thus, simple lateral movement of the recording head allows the cam to rotate in the forward direction, which activates the suction cap, the suction pump, and the wiper to clean the recording head.

The suction pump is activated by the second cam surface. The suction cap and the wiper are driven by the first cam surface. Thus, the suction pump is operated independently from the suction cap and wiper with a single cam. This structure greatly simplifies the control operation.

The recording head can be secured at a predetermined position in the maintenance area by the lock which is activated by the third cam surface.

A maintenance cycle is completed by moving the suction cap and the wiper toward the recording head, sucking the ink out of the recording head using the suction pump, and drawing the suction cap and the wiper back.

In this cycle, when the suction cap covers the nozzle surface, the ink is sucked out of the recording head into the suction cap by the suction pump. Then, at least a portion of the suction cap is removed from the nozzle surface, and the ink is discharged from the suction cap by the suction pump. With this two-step suction, the ink remaining in the recording head can be efficiently removed.

In particular, two kinds of suctions are performed in a cycle under a small suction and a large suction. This can prevent air from mixing into the ink which is flowing through multiple ink paths and generating air bubbles in the recording head.

BRIEF DESCRIPTION OF THE DRAWINGS

The above and other objects, features, and advantages of the invention will be apparent from the detailed description which follows with reference to the drawings, wherein.

DETAILED DESCRIPTION OF THE PREFERRED EMBODIMENTS

The preferred embodiments of the invention will now be described with reference to the attached drawings.

Figure 1:
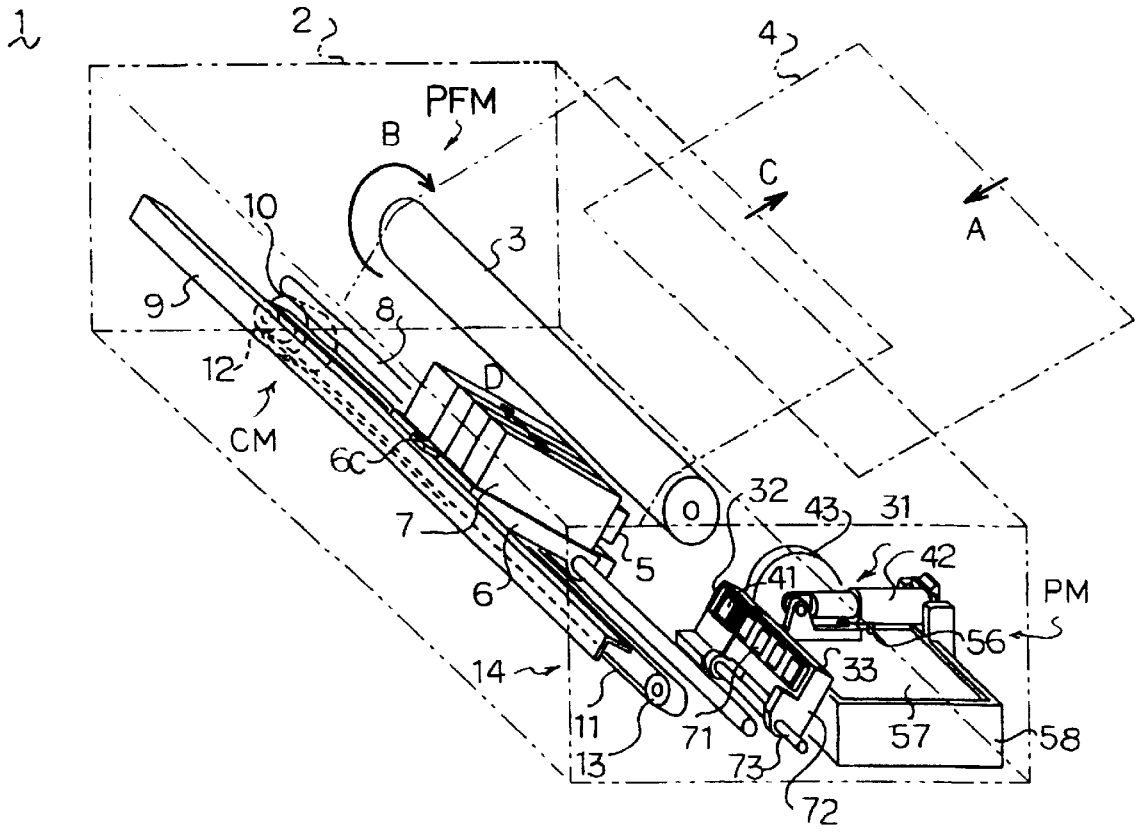
FIG. 1 is a perspective view of the ink-jet printer according to an embodiment of the invention.

FIG. 1 illustrates the internal structure of the ink-jet printer having a maintenance mechanism according to the invention. The ink-jet printer 1 has a cylindrical platen roller 3 which rotates about a shaft (not shown) fixed to the frame 2 and extending in the lateral direction. The platen roller 3, which is a part of the paper-feed mechanism PFM, transports a sheet of paper 4 (i.e., a recording medium) supplied from a paper cassette or a feeder so that the printing surface of the paper faces the recording head 5. The recording head 5 is an ink-jet type recording head, and has nozzles for ejecting ink drops toward the paper 4. The paper-feed mechanism PFM includes an LF motor 14 (Shown in FIG. 3) which drives the paper-feed mechanism PFM in order to transport the paper 4.

The paper 4 is supplied from a paper-supply port (not shown) behind the frame 2 in the direction shown by arrow A, turned around the platen roller 3 in the direction shown by arrow B, and ejected from the paper-ejecting port (not shown) in the direction shown by arrow C. A carriage 6 is positioned in front of the platen roller 3. The carriage 6 moves in the direction shown by arrow D in parallel to the shaft of the platen roller 3.

Figure 2:
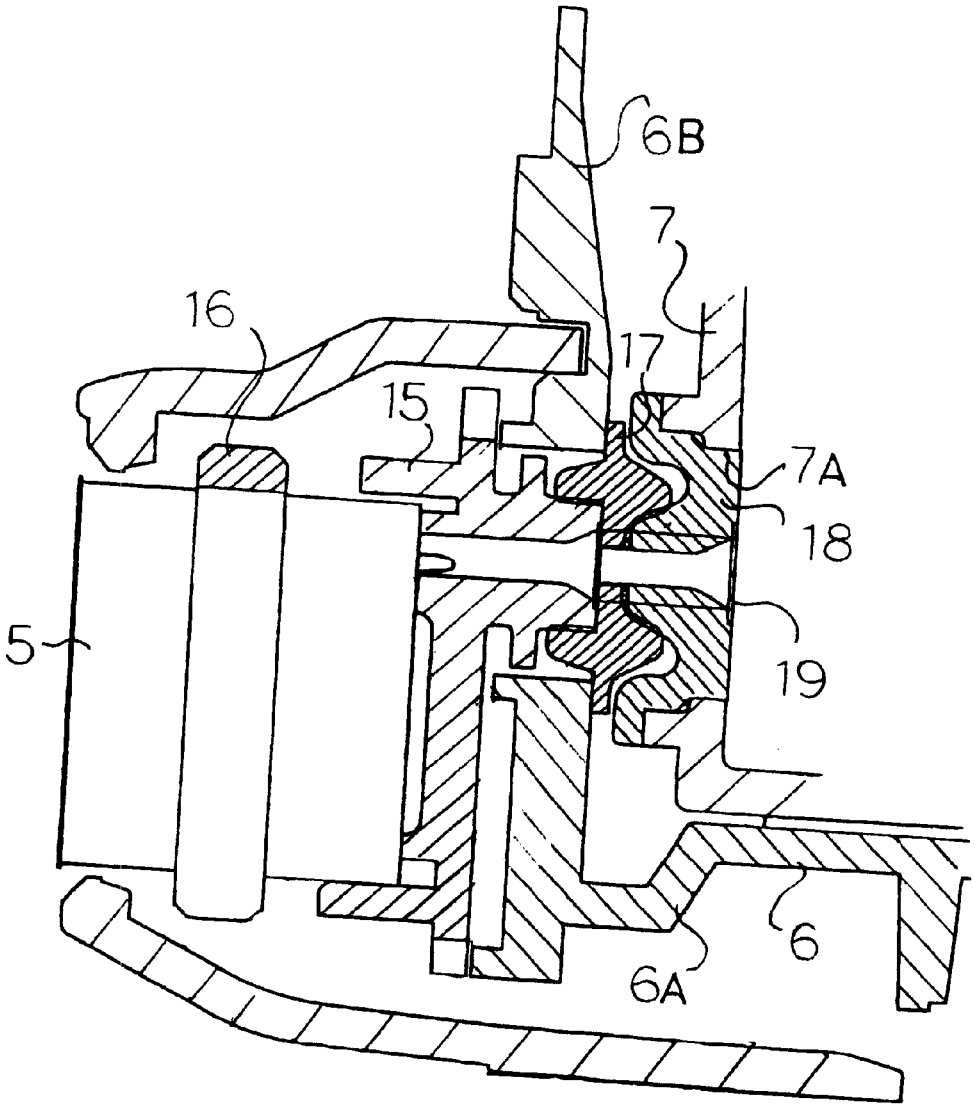
FIG. 2 is a cross-sectional view showing the connection of the recording head to the ink cartridge.

The recording head 5 and the ink cartridge 7 that contains ink to be supplied to the recording head 5 are attached to the carriage 6 in a detachable manner. As shown in FIG. 2, when the ink cartridge 7 is attached to the cartridge receiver 6A of the carriage 6, it is connected via a manifold 15 to the recording head 5 held by the head holder 16. The rear end of the manifold 15 penetrates the vertical wall 6B of the cartridge receiver 6A, and is connected to the ink cartridge 7 via a joint 17. The ink cartridge 7 has an ink supply hole 7A which is located in this connecting section. The ink supply hole 7A is provided with an adapter 18 and a meshed filter 19 for removing dust or other undesired particles. In this embodiment, the recording head 5 comprises four heads corresponding to yellow, black, cyan, and magenta. Similarly, although FIG. 2 shows only one ink cartridge 7, four ink cartridges are used corresponding to these four colors.

The carriage shaft 8 extends in parallel to the shaft of the platen roller 3, and the carriage 6 is supported by this carriage shaft 8 in a slidable manner. The carriage 6 has a small projection 6C which communicates with a guide rail 9 that extends parallel to the carriage shaft 8, whereby the carriage 6 is guided by the guide rail 9 along the sliding direction indicated by arrow D. In this structure, the recording head 5 mounted on the carriage 6 moves back and forth along the platen roller 3. The carriage 6 is fixed to a part of the timing belt 11 which is wound around timing pulleys 12 and 13. The carriage 6, the timing belt 11, and the pulleys 12 and 13 comprise a carriage mechanism CM. The timing pulley 12 is connected to a CD motor (carriage driving motor) 10 which is, for example, a step motor or a DC motor. When the CD motor is driven, the carriage 6 moves back and forth along the shaft 8 within the recording area which is defined by the length of the platen roller 3.

The carriage mechanism CM and the CD motor comprise a shifting mechanism for shifting the positions of the carriage 6 and the recording head 5 between the recording area, in which a recording operation is performed, and the maintenance area, in which the recording head 5 is cleaned in order to prevent a malfunction of the recording head 5. The maintenance area is located next to the recording area.

A purging mechanism PM is provided next to the platen roller 3 so as to face the maintenance area. The purging mechanism PM includes a wiper 32, and a suction device 3 which consists of a suction cap 41 and a suction pump 42. During printing, air bubbles are generated in the ink, and the ink itself is apt to dry. These factors often cause the ink-jet type recording head 5 to malfunction. In order to avoid such a situation and maintain the recording head 5 in good conditions, the purging mechanism PM is provided.

The purging mechanism PM is movable between the front position projecting toward the sliding path of the recording head 5 and the back position receding from the sliding path of the recording head 5. When the purging mechanism PM is located in the front position, the suction cap 41 of the purging mechanism PM covers the recording head 5 which has been moved to the maintenance area. In this position, the suction pump 42 sucks the ink out of the recording head 5 via the suction cap 41.

The wiper 32 is positioned adjacent to the suction device 31, closer to the recording head 5. The wiper 32 is movable forward and backward so as to wipe the nozzle surface of the recording head 5. On the opposite side of the suction device 31, a preservative capping device 33 is provided. The preservative capping device 33 covers the nozzle surface when the recording head does not perform the printing operation, so that the ink does not evaporate and the nozzle surface does not dry out.

A cam 43 is provided to activate the wiper 32, the suction cap 41, and the suction pump 42. To be more precise, the cam 43 has a first cam surface 43E for driving the wiper 32 and the suction cap 41 forward and backward, and a second cam surface 43F for activating the suction pump 42. (See FIGS. 4 and 7) Thus, by simply rotating the cam 43 by one revolution in the forward direction, the forward and backward movement of the wiper 32 and the suction cap 41, and activation of the suction pump 42 are independently achieved.

Figure 3:
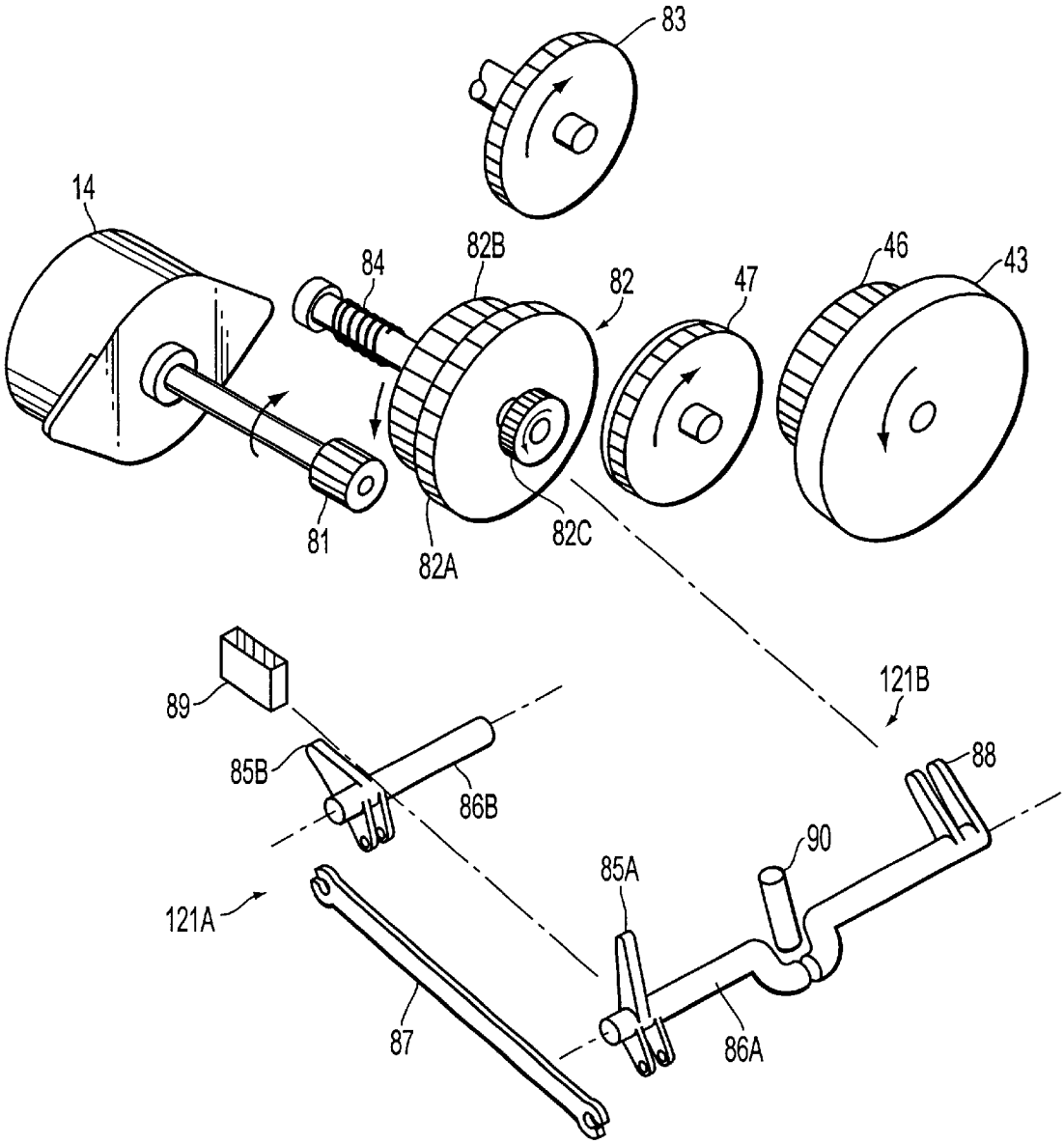
FIG. 3 is an exploded perspective view of a power connection/disconnection mechanism according to the invention.

The cam 43 has a driving gear 46 which meshes with a driving gear 47 that is rotated by the LF motor 14 of the paper-feed mechanism PFM. In other words, the LF motor 14 is used as a driving source to rotate the cam 43 in the forward direction. FIG. 3 shows the detailed structure of the power train. The output shaft of the LF motor 14 is connected to gear 81 which meshes with gear part 82A of a stepped gear 82. The stepped gear 82 also has gear parts 82B and 82C which are formed integratedly with the gear part 82A. As the gear part 82A rotates, the gear part 82C transfers the power to the cam 43 via other gears 46 and 47. At the same time, the gear part 82B rotates the platen roller 3 via the driving gear 83 of the platen roller 3.

The stepped gear 82 is slidable along its shaft. A spring 84 forces the stepped gear 82 to a position where the gear part 82C appropriately meshes with the gear 47. When the stepped gear 82 is slid along its shaft against the spring force by a connection/disconnection mechanism, then the gear part 82C is disengaged from the gear 47, whereby the power transfer to the cam 43 is cut off. On the other hand, the gear parts 82A and 82B of the stepped gear 82 are always meshed with gears 81 and 83, respectively, no matter where the stepped gear 82 is positioned in its sliding range.

The connection/disconnection mechanism comprises a position detector 121A for determining whether the recording head 5 lies in the recording area or the maintenance area, and a coupler 121B which causes the LF motor 14 to link with the cam 43 when the recording head 5 is in the maintenance area.

The positioned detector 121A has a pair of levers 85A and 85B which are linked with each other via a link 87. The levers 85A and 85B are positioned directly under the sliding path of the carriage 6. When the carriage 6 is in the recording area, the lever 85B is down, while the lever 85A is erect and projects into the sliding path of the carriage 6, as shown in FIG. 3. As the carriage 6 moves to the maintenance area, the lever 86 rises into the sliding path, while the lever 85A is pushed down by the carriage 6. Thus, the levers 85A and 86B serve as switches, one of which contacts the carriage 6, while the other does not, whereby the position of the recording head 5, which is mounted on the carriage 6, can be detected by the states of the levers 85A and 85B. The levers 85A and 85B are fixed to shaft 86A and 86B, respectively. Shaft 86A and 86B are rotatable, and extend in a direction perpendicular to the sliding path of the carriage 6.

A pushing lever 88 is integrally formed on the other end of the shaft 86A. The pushing lever 88 pushes the gear part 82C of the stepped gear 82 to disengage the gear part 82C from the gear 47 when the lever 85A is erect (i.e., when the recording head 5 is in the recording area) as shown in FIG. 3. As the carriage 6 moves to the maintenance area, the lever 85A is lowered, and the shaft 86A rotates upward 90° in the clockwise direction. In response to this action, the pushing lever 88 separates from the stepped gear 82 and, as a result, the gear part 82C meshes with the gear 47 by the force of the spring 84. Thus, the lever 85A, the shaft 86A, and the pushing lever 88 comprise a coupler 121B that causes the LF motor 14 to link with the cam 43 when the recording head 5 is in the maintenance area.

The lever 85A only rotates 90 degrees because its rotation is stopped by stoppers (not shown) in an erecting position and a sitting position. A spring 90 facilitates the rotation of the lever 85A. The bottom end of the spring 90 is fixed to the middle point of the shaft 86A. If this fixing point is offset from a theoretical vertical line passing through the middle point of the shaft 86A as the shaft 86A rotates together with the lever 85A, the force of the spring 90 further rotates the shaft 86A until the lever 85A contacts either stopper. The spring 90 also facilitates the pushing lever 88 to push the stepper gear 82. The force of the spring 90 is greater that the force of the spring 84 which pushes the stepper gear 82 from the opposite direction. The carriage 6 has a projection 89 which contacts the lever 85A and pushes the lever 85A downward as the carriage 6 moves to the maintenance area.

Figure 5:
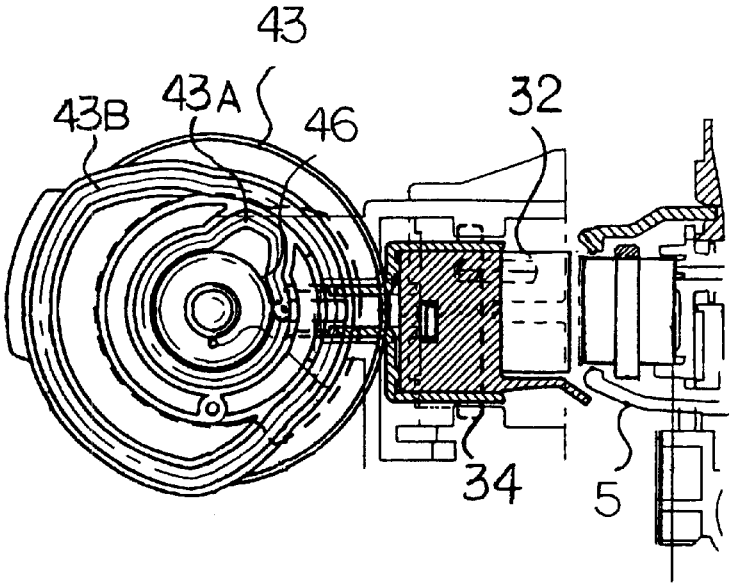
FIG. 5 is a vertical cross-sectional view showing the positional relationship between a wiper and cam according to the invention.

FIG. 5 illustrates how the cam 43 drives the wiper 32. The rear end (the cam follower) of the wiper holder 34 is fit into the first groove 43A of the cam 43. As the cam 43 rotates, the wiper holder 34 moves forward toward, or backward from, the recording head 5 along the direction perpendicular to the sliding path of the recording head 5. At a front position, the wiper 32 wipes the nozzle surface of the recording head 5.

Figure 4:
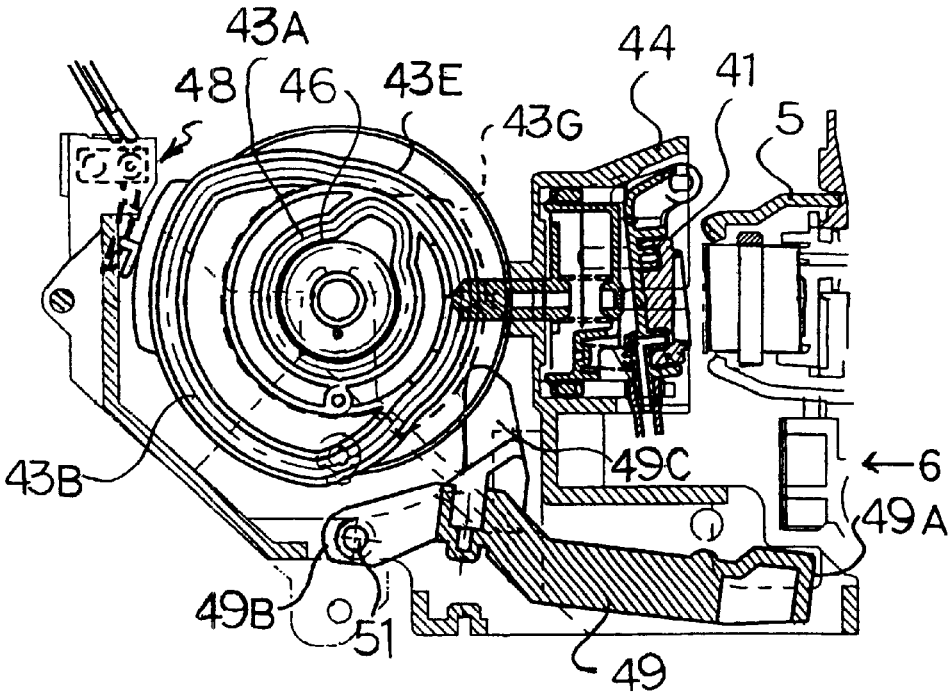
FIG. 4 is a vertical cross-sectional view showing the positional relationship between a suction cap, lock, and cam according to the invention.

As shown in FIG. 4, the suction cap 41 is held by a cap holder 44. The rear end (i.e., the cam follower) of the cap holder 44 is fit into the second groove 43B that is formed in the same cam surface as the first groove 43A. A cam-position sensor 48 for detecting the rotational position of the cam 43 is positioned adjacent to the cam 43. A pivotable lock 49 is positioned under the cam 43 in order to lock the carriage 6 at a purging position. The supporting end 49B of the lock 49 is supported about a pivoting axis 51, and the locking end 49A actually serves as a lock. The lock 49 has a projection 49C near the supporting end 49B. The projection 49C is engaged with the third cam surface 43G which extends between the first and second cam surfaces 43E and 43F. As the cam 43 rotates, the locking end 49A locks and unlocks the carriage 6.

There are five recesses formed in the bottom surface of the carriage 6. The locking end 49A is successively engaged with one of these recesses. Four recesses among the five recesses are used to fix the nozzles for four colors (i.e., yellow, magenta, cyan, and black) one by one in front of the suction cap 41. The remaining recess is used to keep the nozzle surface in the correct position where the preservation caps 71 correctly cover the nozzles, so that the ink in the nozzles does not dry when the recording operation is not performed.

Figure 6:
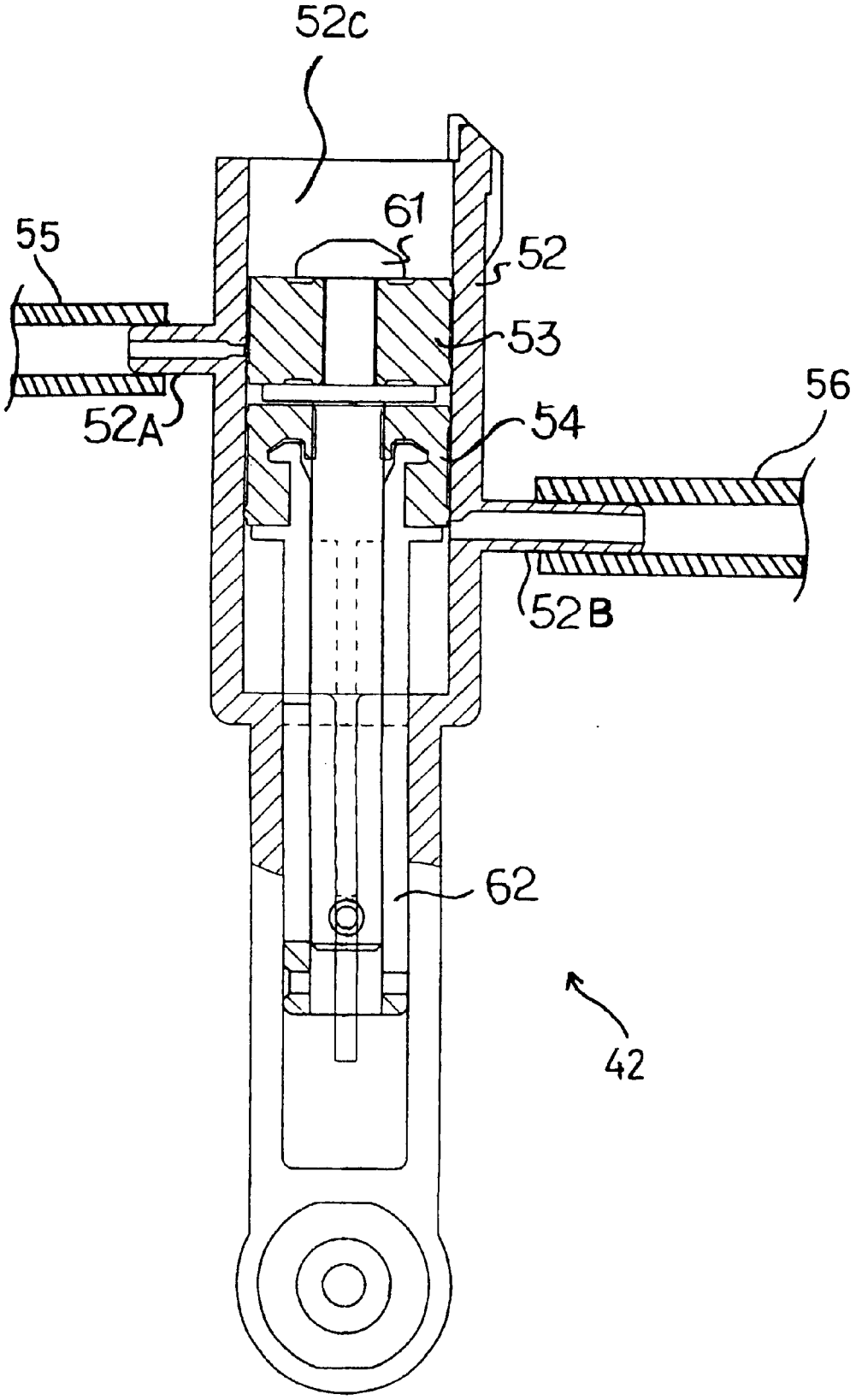
FIG. 6 is a cross-sectional view of a suction pump according to the invention.
Figure 7:
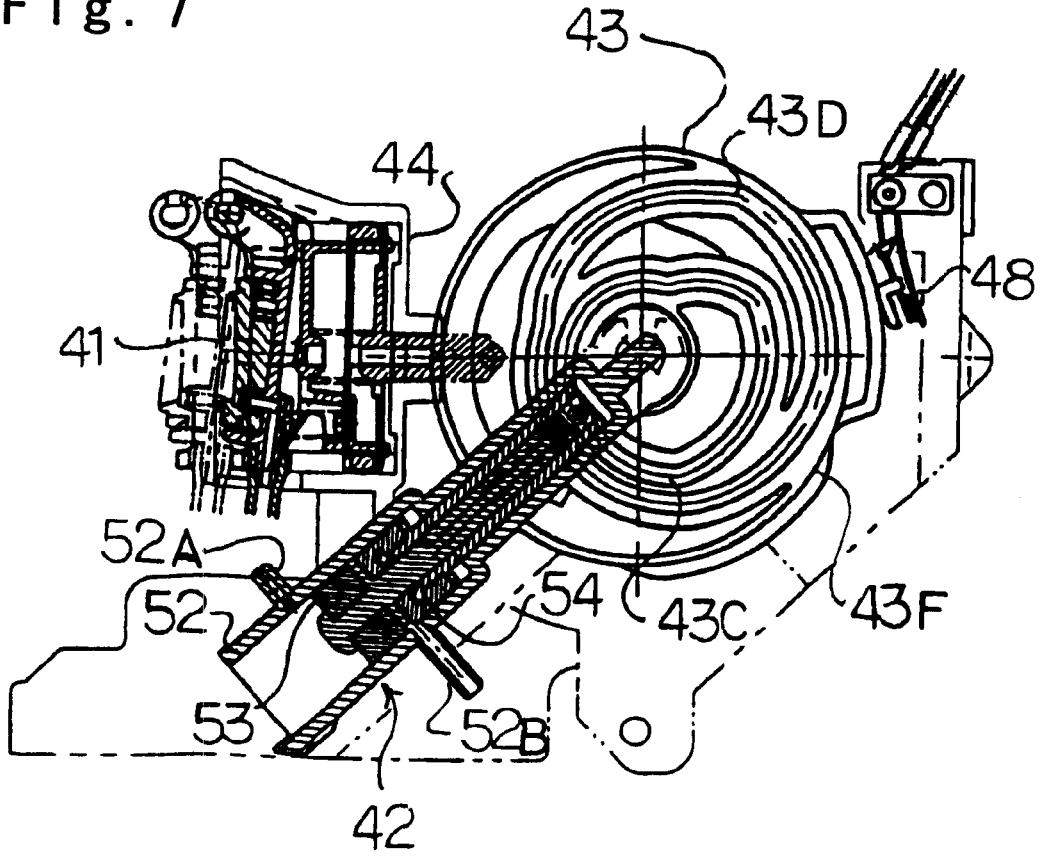
FIG. 7 is a vertical cross-sectional view showing the positional relationship between the suction and the cam according to the invention.

FIG. 6 illustrates the suction pump 42, and FIG. 7 illustrates how the suction pump 42 is activated by the cam 43. As shown in FIG. 6, the suction pump 42 has a cylindrical housing 52 which is secured to a frame (not shown). First and second pistons 53 and 54 independently move inside the housing 52. An inlet port 52A and an outlet port 52B are formed in the housing 52. A space is defined between the inlet port to 52A and the outlet port 52B in the longitudinal direction. The inlet port 52A is connected to the suction cap 41 via a suction pipe 55. The outlet port 52B is connected via an ejection pipe 56 to the discharged-ink tank 58, the interior of which is filled with an absorbent material. An opening 52C is provided at one end of the housing 52. The first piston 53 is positioned closer to the opening 52C, and the second piston 54 is positioned on the other side.

The first piston 53 is coupled to one end of the first driving shaft 61, while the second piston 54 is coupled to the second driving shaft 62, whereby the pistons 53 and 54 are independently moved in the housing 52. The inner wall of the housing 52 and the first and second pistons 53 and 54 define a pump chamber within the housing 52.

The first driving shaft 61 is inserted in the second driving shaft 62 in a slidable manner. The other end of the first driving shaft 61 is fit into the third groove 43C, while the other end of the second driving shaft 62 is fit into the fourth groove 43D. Grooves 43C and 43D are formed on the cam surface opposite to where the first and second grooves 43A and 43B are formed. The fitting ends of driving shafts 61 and 62 move along the grooves 43C and 43D as the cam 43 rotates, thereby driving the pistons 53 and 54 of the suction pump 42.

In one revolution of the cam 43, the suction cap 41 initially contacts the nozzle surface, then the ink is sucked out of the recording head by the suction pump 42. The nozzle surface is subsequently wiped by the wiper 32. The ink sucked by the suction pump is discharged in the discharged-ink tank 58, and absorbed by the absorbent material.

The suction pump 42 shown in FIG. 6 may be replaced with the pump disclosed in U.S. Pat. No. 5,639,220, the entire contents of which is incorporated hereinto by reference.

Figure 8:
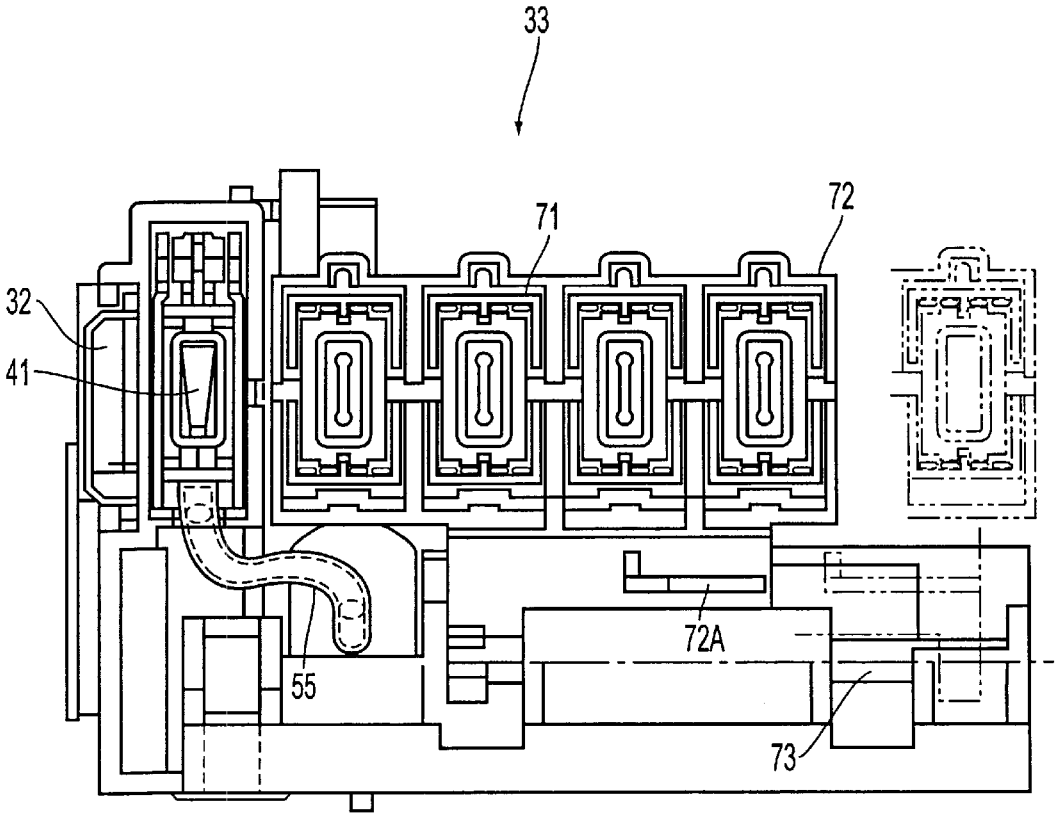
FIG. 8 is a front view of a preservative capping device according to the invention.
Figure 9:
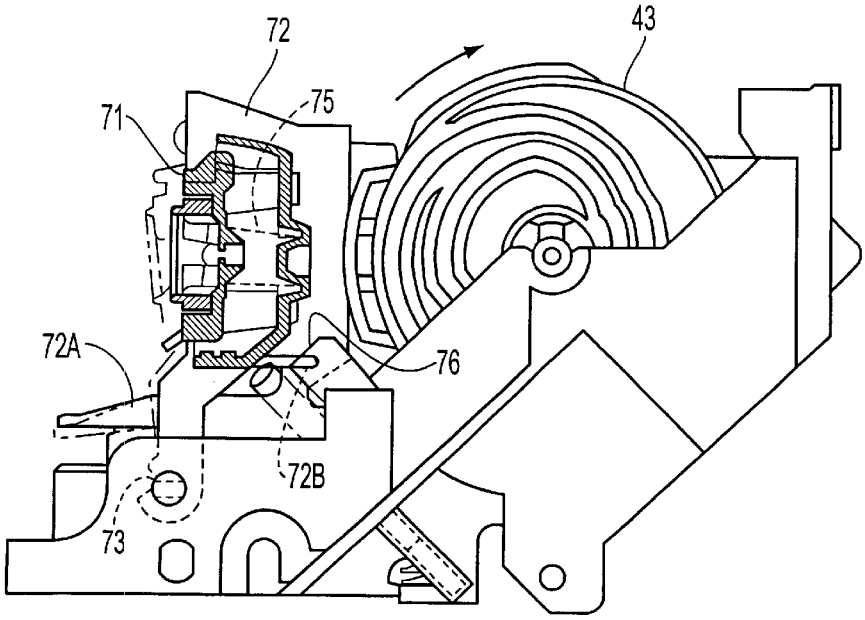
FIG. 9 is a partial cross-sectional side view of the preservative capping device shown in FIG. 8.
Figure 10:
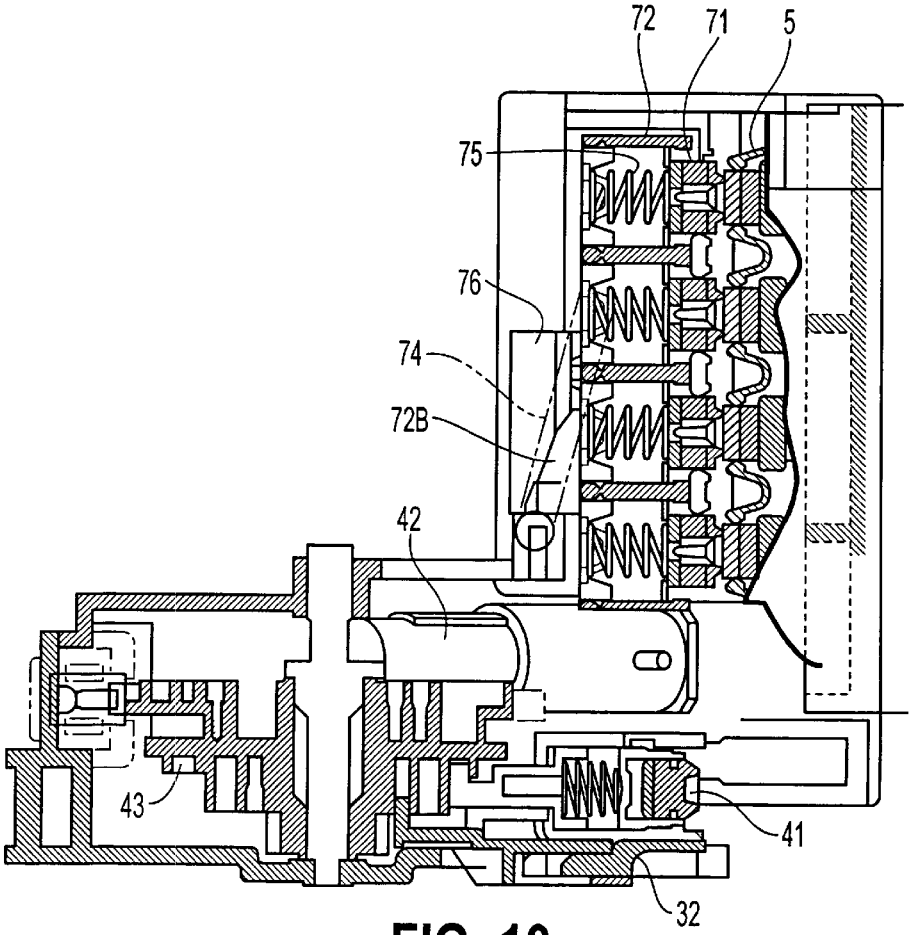
FIG. 10 is a partial cross-sectional plan view of the preservative capping device shown in FIG. 8.

As has been mentioned above, the nozzle surface is covered with the preservation cap 71 when the recording operation is not performed. FIGS. 8 through 10 illustrate the preservative capping device 33 used in this embodiment. In the preservative capping device 33, a preservation cap 71, which comprises four small caps, is held by a casing 72. The casing 72 is supported in a slidable and pivotable manner by a guide rod 73 that extends in the sliding direction of the carriage 6. In the recording area, the casing 72 is forced apart from the recording head 5 by a spring 74, as shown in FIG. 10. A spring 75 is provided between the preservation cap 71 and the casing 72. In the maintenance area, the spring 75 forces the preservation cap 71 toward the recording head 5 about its pivot axis.

As shown in FIGS. 8 through 10, the casing 72 has a first projection 72A, which projects forward and is engaged with the carriage 6 when the carriage has entered the maintenance area from the recording area, a second projection 72B which projects backward, and a guide 76 provided on the back of the casing 72. As the casing slides together with the carriage 6 in the maintenance area to the purging position, the guide 76 causes the casing 72 to pivot about the guide rod 73 by meshing with the second projection 72B. The guide 76 extends obliquely toward the moving path of the recording head 5.

As has been mentioned, when the carriage 6 enters the maintenance area, the carriage 6 is engaged with the first projection 72A of the casing 72, and the preservation cap 71 slides following the motion of the carriage 6. At this time, the casing 72 pivots toward the recording head 5, and the preservation cap contacts the nozzle surface. If the carriage 6 further moves into the maintenance area (to the right in FIG. 1), the spring 75 between the preservation cap 71 and the casing 72 is compressed, whereby the four nozzles corresponding to the four colors are capped with four small caps under a uniform pressure.

When the carriage 6 starts moving back to the recording area, the preservation cap 71 separates from the recording head 5, while it is slightly pushed back toward the recording area by the spring 74. When the carriage 6 completely leaves the maintenance area, the preservation cap 71 returns to its initial position.

Figure 11A:
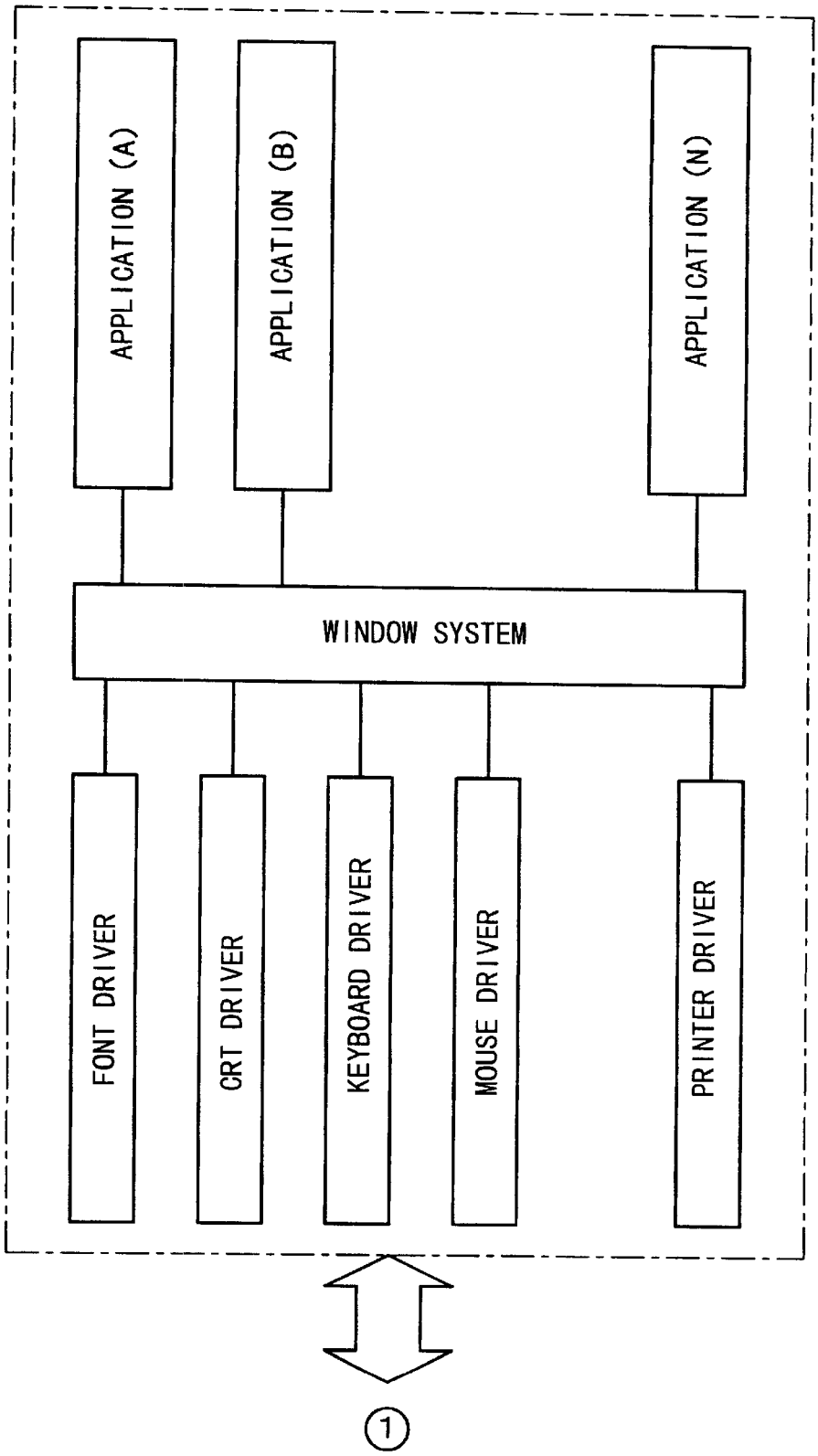
FIGS. 11A and 11B are block diagrams of a controller of the ink-jet printer according to the invention.
Figure 11B:
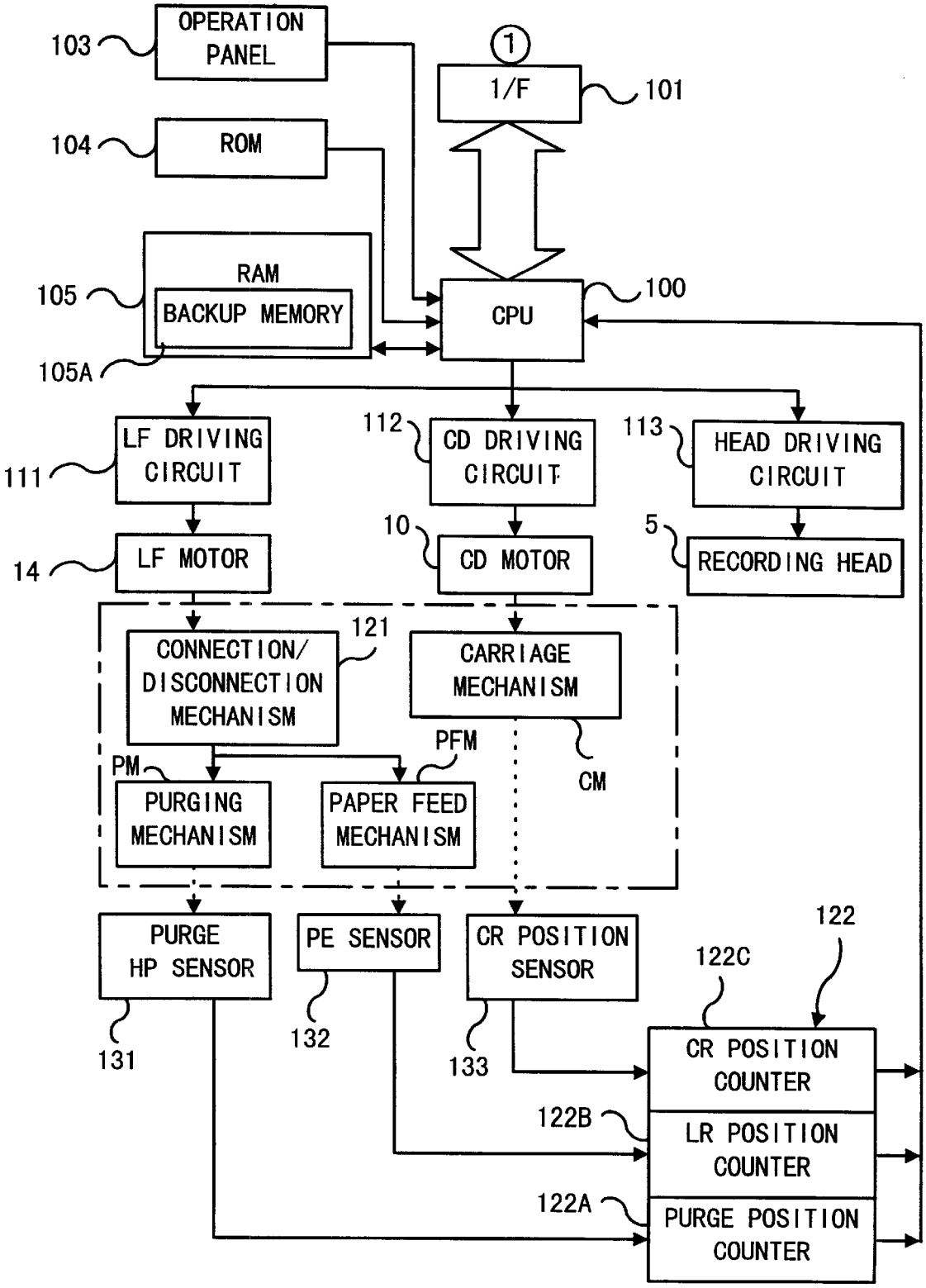

Next, the control system of the ink-jet printer 1 according to this embodiment will be explained with reference to FIGS. 11A and 11B. The control system has a conventional CPU 100 in its center. The CPU 100 is connected to a host computer 102, such as a personal computer, via an interface 101. When the CPU 100 receives a print command from the host computer 102, the CPU 100 performs the printing operation in response to the command.

Typically, the host computer 102 has a window system, in which various applications (A), (B), . . . (N) are installed. Also, various driver systems, such as font driver, CRT driver, keyboard driver, mouse driver, and printer driver are incorporated. If a print command is issued during the execution of an application, the printer driver creates image output data suitable to the functions of the ink-jet printer 1. The CPU 100 is also connected to an operation panel 103, a ROM 104, and a RAM 105. The operation panel is used to set and display various parameters, such as paper size. The ROM 104 stores programs required to control the ink-jet printer 1. The significant programs stored in the ROM 104 include a suction program for bringing the suction cap 41 into contact with the nozzle surface and sucking the ink remaining in the recording head 5, and a vacant suction program for further sucking the ink out of the suction cap 41 to discharge the ink. The RAM 105 has a backup memory 105A, and temporarily stores the print data transferred from the host computer 102 and various values required to control the ink-jet printer 1.

The CPU 100 controls the LF driving circuit 111, the CD driving circuit 112, and the head driving circuit 113 to drive the LF motor 14, the CD motor 10, and the recording head 5.

The LF motor 14 is used as a paper-feed motor during the printing operation. The driving power of the LF motor 14 is selectively transferred to the purging mechanism PM via the connection/disconnection mechanism 121, which includes the position sensor 121A and the couplers 121B.

The CD motor 10 is used to drive the carriage mechanism CM. The driving force of the CD motor 10 either is, or is not, transferred to the cam 43 via the connection/disconnection mechanism 121 depending on the position of the carriage 6.

The purging mechanism PM, the paper-feeding mechanism PFM, and the carriage mechanism CM have their own sensors, namely, a purge HP sensor 131, a PE sensor 132, and a CR position sensor 133, respectively. The detection signals from these sensors are input to the CPU 100 via the counter group 122. The purge HP sensor 131 of the purging mechanism PM supplies a reference signal to the purge-position counter 122A when the suction pump is positioned at the home position. This reference signal is used as a reference for the purge operation.

The PE sensor 132 of the paper-feed mechanism PFM generates a signal when it detects the leading edge of the printing paper 4. This signal is supplied to the LR position counter 122B, and is used as a reference to control the recording position in the longitudinal direction.

The CR position sensor 133 of the carriage mechanism CM detects the position of the carriage 6 by counting the driving pulses of the CD motor 10, and generates a detection signal which is supplied to the CR position counter 122C. This positional information is used as a reference to control the recording position in the lateral direction, as well as a reference to determine the timing for supplying a new sheet of paper 4 and ejecting the printed paper.

In the operation of the ink-jet printer 1, the recording head 5 is covered with the preservation cap 71 when no print command is supplied from the computer. When recording data is input to the CPU 100 of the ink-jet printer 1, the recording operation starts.

A sheet of paper 4 is fed between the platen roller 3 and the recording head 5 and, at the same time, the recording head 5 is moved from the waiting position to the print starting position. At this time, the preservation cap 71 recedes from the sliding path of the recording head 5. Then, the recording head 5 moves back and forth in the recording area while ejecting ink based on the recording data, whereby the data is printed on the paper 4.

When the data is all printed out, and when there is no data left in memory of the RAM 105, the recording head 5 returns to the waiting position. The preservation cap 71 is moved forward and covers the nozzle surface of the recording head 5 to prevent the ink at the nozzle surface from drying.

If the operator inputs a purge command through the purge switch on the operation panel 103, the ink-jet printer enters the purge mode, and the suction program is executed to activate the purging mechanism PM. The CD motor drives the carriage mechanism CM, and the recording head 5 moves from the waiting position to the maintenance area so as to face the suction cap 41. Prior to this action, the gear train has already been meshed by the connection/disconnection mechanism 121 while the recording head 5 is at the waiting position, and it is now capable of transferring the driving force of the LF motor 14 to the purging mechanism PM. Upon receiving the driving force from the LF motor 14, the cam 43 rotates once. In one revolution of the cam 43, the suction cap 41 and the wiper 32 move forward to recording head 5, then the suction pump 42 sucks the ink out of the recording head 5, and finally, the suction cap 41 and the wiper 32 move back to the initial position.

The purging mechanism performs a two-step suction. In the first step, the suction cap 41 completely covers the nozzle surface, and the ink is sucked out of the recording head 5 by the suction pump 42. Then, in the second step, at least a part of the suction cap 41 is spaced from the nozzle surface, and the ink remaining in the suction cap 41 is removed by the suction pump 42. The second step is called a vacant suction.

The purge mode is selected by the operator to generally clean the recording head 5. However, the purge mode may be used whenever the ink needs to be sucked out of the recording head 5, for example, when the ink cartridge is exchanged or the ink-ejection condition becomes bad.

The maintenance operation (or the purging operation) of the ink-jet printer 1 will now be explained with reference to FIGS. 12 through 14. The small numbers written in the figures denote the rotational angles of the cam 43.

First, the recording head 5 is moved to the position facing the suction cap 41 under the control of the CPU 100. Then, a series of maintenance operations for keeping the ink ejection condition in order are performed under the control of the cam 43. The cam 43 activates the suction cap 41, the suction pump 43, the wiper 32, and the lock 49.

Figures 12A, 12B, 12C, 12D, 12E, 12F, 12G:
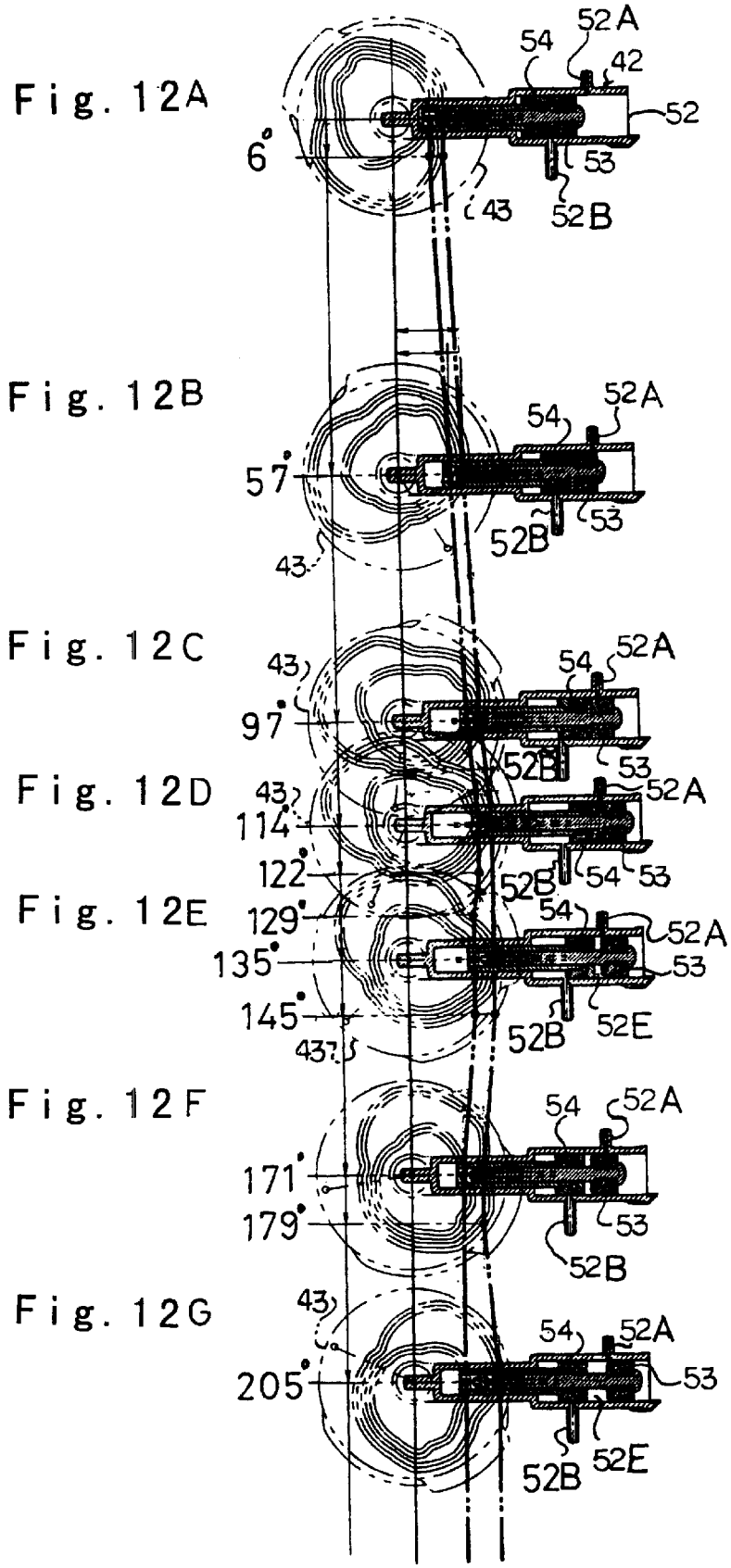
FIGS. 12(A) through 12(J) show the operation of the suction pump.
Figures 12H, 12I, 12J:
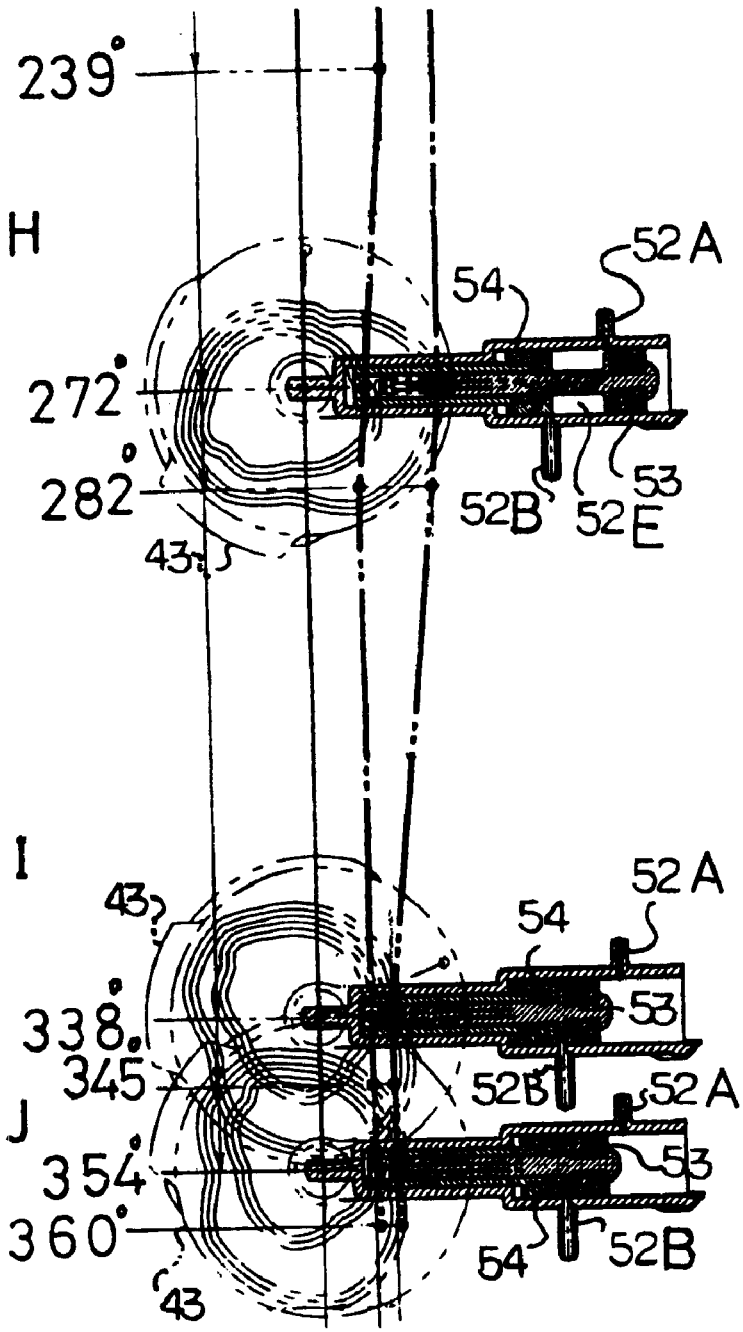
Figure 13A:
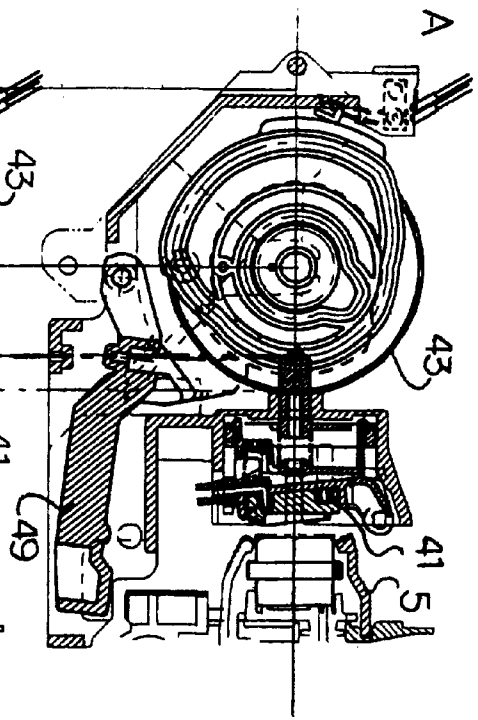
FIGS. 13(A) through 13(G) show the operation of the suction cap and the lock.
Figure 14A:
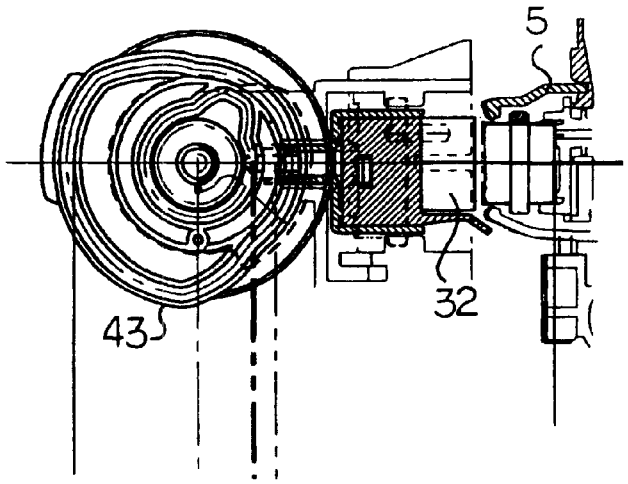
FIGS. 14(A) and 14(B) show the operation of the wiper.
Figure 14B:
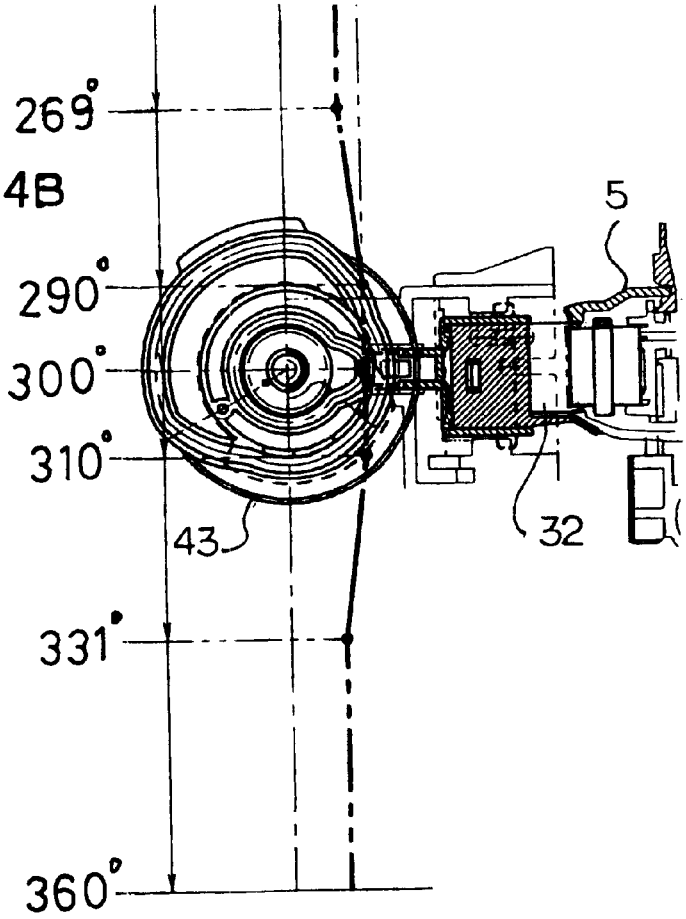

When the rotational angle of the cam 43 is approximately 0°, the first and second pistons 53 and 54 of the suction pump 42 are positioned near the outlet port 52B. At this time, the volume of the pump chamber formed between the first and second pistons is minimal, as shown in FIG. 12(A), while the suction cap 41 and the wiper 32 are at the home positions spaced from the recording head 5, as shown in FIGS. 13(A) and 14(A).

Figure 13B:
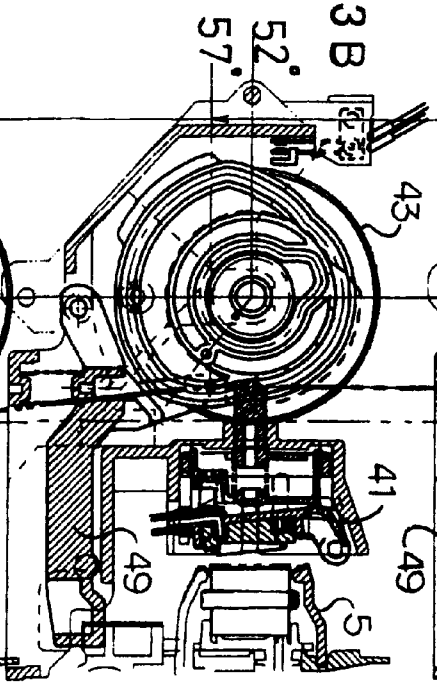
Figure 13C:
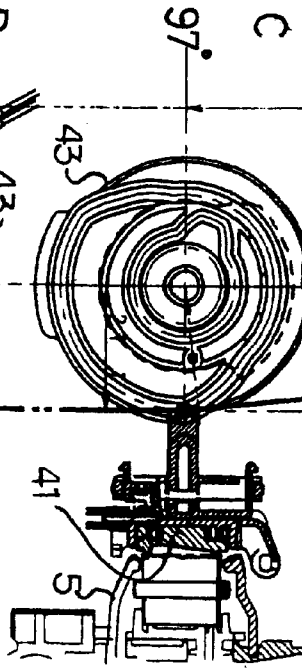
Figure 13D:
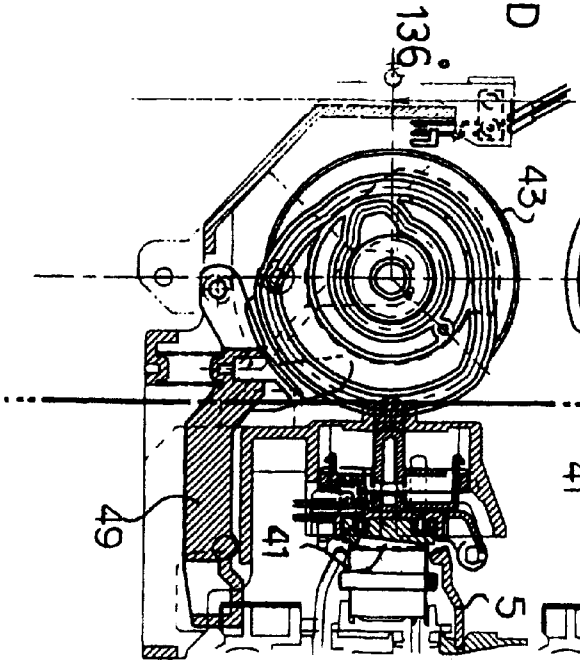
Figures 13E, 13F, 13G:
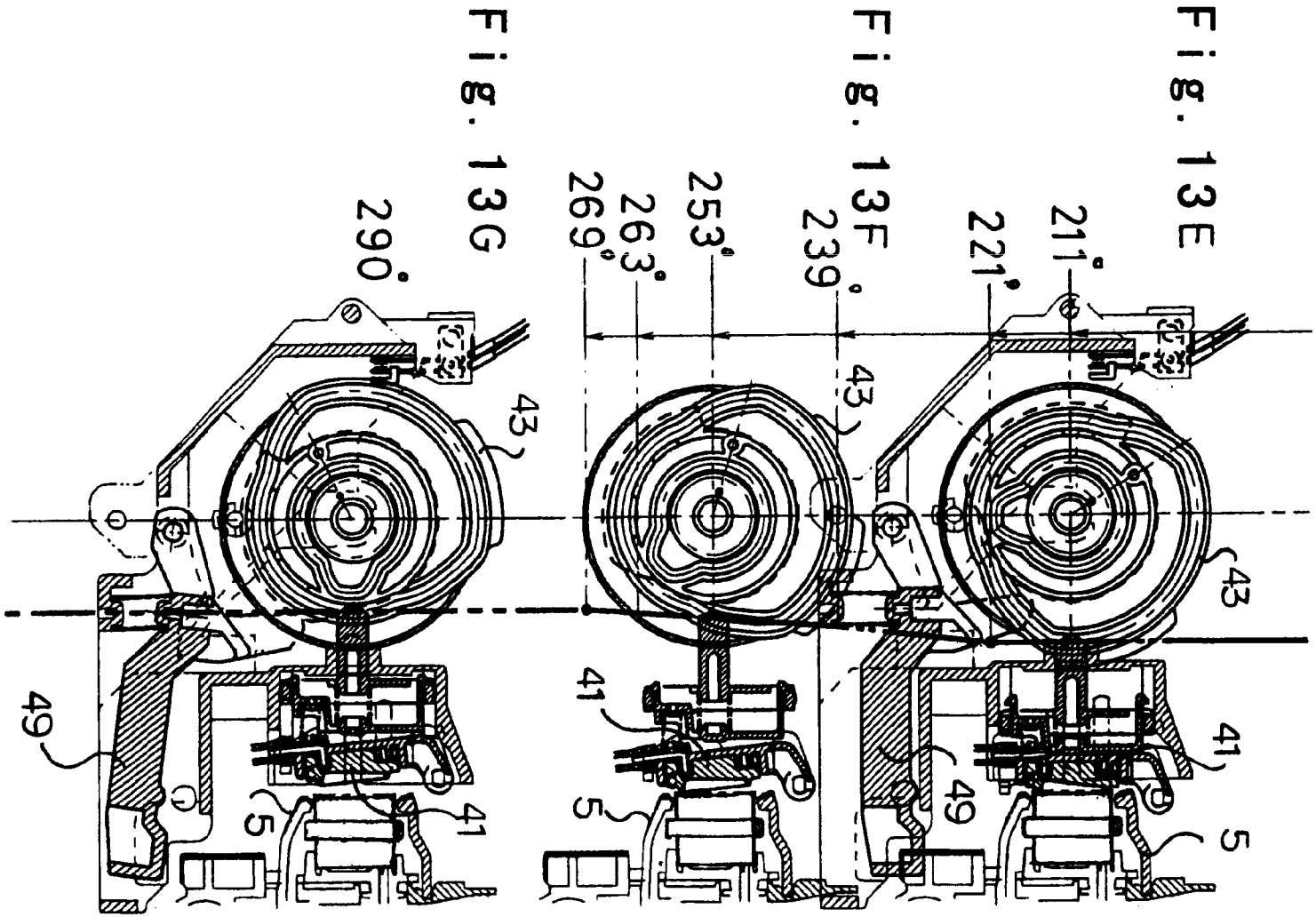

As the carriage 6 moves into the maintenance area, the driving force of the LP motor is transferred to the cam 43. When the rotational angle of the cam 43 reaches approximately 6°, both the first and second pistons 53 and 54 start moving toward the inlet port 52A, as shown in FIG. 12(B). The moving speeds of the first and second pistons 53 and 54 increase slightly at approximately 97°, as shown in FIG. 12(C). Immediately before this point, the lock 49 starts to erect at about 52° to lock the carriage 6, as shown in FIG. 13(B). When the rotational angle reaches approximately 57°, the suction cap 41 starts advancing from the home position toward the moving path of the recording head 5, and covers the nozzle surface at approximately 97°, as shown in FIG. 13(C).

When the rotational angle of the cam 43 reaches approximately 114°, the first and second pistons 53 and 54 stop moving. At this time, the inlet port 52A is positioned between the first and second pistons 53 and 54, still maintaining a minimal volume of the pump chamber 52E. (FIG. 12(D)).

While the rotational angle changes from 114° to 136°, the first piston 53 is at rest, but the second piston 54 moves backward so as to expand the pump chamber 52E between the first and second pistons 53 and 54. In this state, the pump chamber 52E is connected to the outlet inlet 52A, and the first suction is performed with a small vacuum. (See FIGS. 12(E) and 13(D)). If the recording head 5 contains air, the air is sucked out together with the ink.

Then, while the cam 43 rotates from 136° to 171°, the first and second pistons 53 and 54 move back together while keeping the volume of the pump chamber 52E constant, until the first and second pistons 53 and 54 close the inlet port 52A and the outlet port 52B, respectively. At this point of time, the first suction is completed (FIG. 12(F)).

This state is maintained during the cam rotation from 171° to 179°. Then, when the rotational angle changes from 179° to 205°, the second piston 54 is at rest (still covering the outlet port 52B), while the first piston 53 moves in the direction to expand the pump chamber 52E so as to fully open the inlet port 52A, as shown in FIG. 12(G). In response to this volume expansion, the pressure inside the pump chamber 52E becomes very low, and a large vacuum is achieved. This state is maintained until the rotational angle reaches 239°, during which the second suction is performed with a large vacuum. The second suction period is longer than the first suction period.

The suction cap 41 still contacts the nozzle surface until the rotational angle reaches about 221°. Specifically, the suction cap 41 contacts the nozzle surface until just after the second suction starts (FIG. 13(E)). Then, the suction cap 41 is gradually separated from the nozzle surface of the recording head 5 (FIG. 13(F)), and is completely separated from the nozzle surface by an angle of 239°.

From the rotational angle of 239° to 272°, the first piston 53 is at rest with the inlet port 52A open, while the second piston 54 moves in order to further expand the pump chamber 53E until the second piston 54 reaches the position where the outlet port 52B is about to open. Through this suction, the ink remaining in the suction cap 41, which is now spaced from the nozzle surface, is sucked out by the pump 42.

While the cam 43 rotates from 272° to 282°, the second piston 54 keeps moving and opens the outlet port 52B, and the first piston 53 also moves in the same direction in order to close the inlet port 52A. The second piston 54 stops at an angle of 282°, but the first piston 5E3 keeps moving until the rotational angle reaches approximately 338° (FIG. 12(J)). Through this action, the pump chamber 52E is compressed, and the ink is discharged from the outlet port 52B into the discharged ink tank 58.

After the discharge, the first and second pistons 53 and 54 are kept at rest from 338° to 345°. Then, the first and second pistons 53 and 54 start moving slightly and return to their initial positions at 354°. The initial state is maintained until the cam 43 makes one revolution with the rotational angle of 360°.

The suction cap 41 returns to the waiting position before the rotational angle of the cam 43 reaches 269°. The wiper 32 remains at the waiting position until the rotational angle reaches 269° (FIG. 14(A)). Then, the wiper 32 gradually advances toward the recording head 5 from 269° to 290°, and stays at the projecting position from 290° to 310°. Meanwhile, the lock 49 unlocks the carriage 6 at the rotational angle of 290°, whereby the carriage 6 starts moving back to the recording area As the carriage 6 moves, the nozzle surface of the recording head 5 is wiped by the wiper 32 (FIG. 14(B)). The wiper 32 gradually returns to the waiting position during the cam rotation from 310° to 331°, and stays at the waiting position for the rest of the rotation (until the cam reaches 360°).

In this manner, one revolution of the cam 43 achieves a series of maintenance operations, including driving the suction cap 41 and the wiper 32, and the sucking and discharging the ink using the suction pump 42.

In particular, the ink suction is controlled in two steps by the cam grooves, namely, a first suction with a small vacuum, and a second suction which is performed with a greater vacuum and for a longer time, while gradually separating the suction cap 41 from the nozzle surface. This can prevent air from mixing into the ink. If the ink is sucked from the recording head 5 in a stroke with a large vacuum while keeping the suction cap 41 in contact with the nozzle surface, additional ink abruptly flows into the recording head 5 from the ink cartridge 7 generating bubbles in it. This is more likely to happen when a filter 19 for removing a dust is provided to the recording head 5. In order to avoid such a situation, the cam 43 of the invention is designed so as to perform the two-step suction during the maintenance operations.

Although the invention has been described by way of exemplary embodiment, it should be understood that many changes and substitutions may be made by those skilled in the art without departing from the spirit and the scope of the invention, which is only defined by the appended claims.

What is claimed is:

1. An ink-jet printer for ejecting ink drops at a recording medium, the ink-jet printer provided with a maintenance mechanism for performing a maintenance operation, comprising:

a recording-medium transporter that transports the recording medium;

a driving unit that provides a driving force to drive the recording-medium transporter;

a recording head having a plurality of nozzles and a nozzle surface, the plurality of nozzles ejecting ink drops toward the recording medium;

a suction cap that covers the nozzle surface of the recording head when the maintenance operation is performed;

a suction pump that sucks ink out of the recording head via the suction cap;

a wiper that wipes the nozzle surface of the recording head;

a carriage that holds the recording head;

a lock that secures the carriage at a predetermined position;

a cam that drives the suction cap, the suction pump and the wiper, and a connection/disconnection mechanism that selectively either transfers the driving force provided by the driving unit to the cam to drive the cam in a forward direction only or prevents the driving force provided by the driving unit from being transferred to the cam.

2. The ink-jet printer according to claim 1, further comprising a shifting mechanism that moves the recording head between a recording area, where a recording operation is performed on the recording medium, and a maintenance area, where the maintenance operation is performed using the suction cap, the suction pump, and the wiper, wherein the connection/disconnection mechanism has a coupler that transfers the driving force provided by the driving unit to the cam when the recording head is disposed in the maintenance area.

3. The ink-jet printer according to claim 2, wherein the connection/disconnection mechanism has a stepped gear which is slidable along a gear shaft, the recording head is mounted on a carriage, and the coupler has a first lever which contacts the carriage when the carriage moves to the maintenance area, a second lever that moves the stepped gear along the gear shaft, and a link that links the first lever and the second lever.

4. The ink-jet printer according to claim 1, wherein the driving unit is a single driving motor, the recording-medium transporter is a platen roller, and the cam is driven by said single driving motor in a forward direction.

5. The ink-jet printer according to claim 1, wherein the cam comprises a first cam surface that moves the suction cap and the wiper forward toward, and backward from, the nozzle surface of the recording head, and a second cam surface that activates the suction pump.

6. The ink-jet printer according to claim 5, wherein the suction pump comprises a first piston, a second piston, and a pump housing, the first piston, the second piston and the housing defining a pump chamber, the volume of the pump chamber being variable depending on the positions of the first piston and the second piston, and wherein the second cam surface of the cam has a groove that drives the first piston, and another groove that drives the second piston.

7. The ink-jet printer according to claim 6, wherein the grooves of the cam that drive the first piston and the second piston are formed so that the first piston and the second piston move in such a manner that the suction pump performs a first suction with a small vacuum, and then a second suction with a large vacuum within one revolution of the cam.

8. The ink-jet printer according to claim 5, wherein the cam has a third cam surface extending between the first cam surface and the second cam surface, the third cam surface causing the lock to move between a locked position and an unlocked position.

9. The ink-jet printer according to claim 7, wherein the cam has additional grooves on an opposite cam surface, the additional grooves being formed so that the suction cap covers the nozzle surface during the first suction in order to allow ink to be sucked out of the recording head by the suction pump, and the suction cap is gradually separated from the nozzle surface during the second suction in order to allow ink to be sucked out of the suction cap by the suction pump.

10. The ink-jet printer according to claim 7, wherein the holder that holds a suction cap and the wiper has a preservation cap for covering the nozzle surface of the recording head, and the ink-jet printer further comprises a pivoting guide that guides the preservation cap directly over the nozzle surface to cover the nozzle surface.

11. The ink-jet printer according to claim 1, wherein the lock is driven by the cam.

12. A method of performing a maintenance operation for an ink-jet printer, the ink-jet printer ejecting ink drops at a recording medium and including a recording-medium transporter that transports the recording medium and a recording head that has a plurality of nozzles and a nozzle surface and is held on a carriage, the plurality of nozzles ejecting ink drops toward the recording medium, comprising the steps of:

providing a driving force to drive the recording-medium transporter with a driving unit;

covering the nozzle surface of the recording head with a suction cap when the maintenance operation is performed;

sucking ink out of the recording head via the suction cap with a suction pump;

wiping the nozzle surface of the recording head with a wiper;

driving the suction cap, suction pump and wiper with a cam that moves in a forward direction only;

securing the carriage at a predetermined position with a lock; and selectively either transferring the driving force provided by the driving unit to the cam or preventing the driving force provided by the driving unit from being transferred to the cam with a connection/disconnection mechanism.

13. An ink-jet printer for ejecting ink drops at a recording medium, the ink-jet printer provided with a maintenance mechanism for performing a maintenance operation, comprising:

a recording-medium transporter that transports the recording medium;

a driving unit that provides a driving force to drive the recording-medium transporter;

a recording head having a plurality of nozzles and a nozzle surface, the plurality of nozzles ejecting ink-drops toward the recording medium;

a suction cap that covers the nozzle surface of the recording head when the maintenance operation is performed;

a suction pump that sucks ink out of the recording head via the suction cap;

a wiper that wipes the nozzle surface of the recording head;

a carriage that holds the recording head;

a cam that drives the suction cap, the suction pump and the wiper, the cam having grooves on an opposite cam surface, the grooves being formed so that the suction cap covers the nozzle surface during a first suction in order to allow ink to be sucked out of the recording head by the suction pump, and the suction cap is gradually separated from the nozzle surface during a second suction in order to allow ink to be sucked out of the suction cap by the suction pump and a connection/disconnection mechanism that selectively either transfers the driving force provided by the driving unit to the cam to drive the cam in a forward direction only or prevents the driving force provided by the driving unit from being transferred to the cam.

14. The ink-jet printer according to claim 13, further comprising a shifting mechanism that moves the recording head between a recording area, where a recording operation is performed on the recording medium, and a maintenance area, where the maintenance operation is performed using the suction cap, the suction pump, and the wiper, wherein the connection/disconnection mechanism has a coupler that transfers the driving force provided by the driving unit to the cam when the recording head is disposed in the maintenance area.

15. The ink-jet printer according to claim 14, wherein the connection/disconnection mechanism has a stepped gear which is slidable along a gear shaft, the recording head is mounted on a carriage, and the coupler has a first lever which contacts the carriage when the carriage moves to the maintenance area, a second lever that moves the stepped gear along the gear shaft, and a link that links the first lever and the second lever.

16. The ink-jet printer according to claim 13, wherein the driving unit is a single driving motor, the recording-medium transporter is a platen roller, and the cam is driven by said single driving motor in a forward direction.

17. The ink-jet printer according to claim 13, wherein the cam comprises a first cam surface that moves the suction cap and the wiper forward toward, and backward from, the nozzle surface of the recording head, and a second cam surface that activates the suction pump.

18. The ink jet printer according to claim 17, further comprising a lock that secures the recording head at a predetermined position in the maintenance area.

19. The ink-jet printer according to claim 18, wherein the cam has a third cam surface extending between the first cam surface and the second cam surface, the third cam surface causing the lock to move between a locked position and an unlocked position.

20. The ink-jet printer according to claim 17, wherein the suction pump comprises a first piston, a second piston, and a pump housing, the first piston, the second piston and the housing defining a pump chamber, the volume of the pump chamber being variable depending on the positions of the first piston and the second piston, and wherein the second cam surface of the cam has a groove that drives the first piston, and another groove that drives the second piston.

21. The ink-jet printer according to claim 19, wherein the grooves of the cam that drive the first piston and the second piston are formed so that the first piston and the second piston move in such a manner that the suction pump performs the first suction with a small vacuum, and then the second suction with a large vacuum within one revolution of the cam.

22. The ink-jet printer according to claim 19, wherein the holder that holds a suction cap and the wiper has a preservation cap for covering the nozzle surface of the recording head, and the ink-jet printer further comprises a pivoting guide that guides the preservation cap directly over the nozzle surface to cover the nozzle surface.

23. An ink-jet printer for ejecting ink drops at a recording medium, the ink-jet printer provided with a maintenance mechanism for performing a maintenance operation, comprising:

a recording-medium transporter that transports the recording medium;

a driving unit that provides a driving force to drive the recording-medium transporter;

a recording head having a plurality of nozzles and a nozzle surface, the plurality of nozzles ejecting ink drops toward the recording medium;

a suction cap that covers the nozzle surface of the recording head when the maintenance operation is performed;

a suction pump that sucks ink out of the recording head via the suction cap;

a wiper that wipes the nozzle surface of the recording head;

a carriage that holds the recording head;

a cam, with a plurality of grooves, that drives the suction cap, the suction pump and the wiper; and a connection/disconnection mechanism that selectively either transfers the driving force provided by the driving unit to the cam to drive the cam in a forward direction only or prevents the driving force provided by the driving unit from being transferred to the cam, wherein the driving unit is a single driving motor that drives the cam in forward direction.

24. The ink jet printer according to claim 23, wherein the plurality of grooves correspond respectively to the suction cap, the suction pump and the wiper.

25. The ink jet printer according to claim 23, wherein the plurality of grooves are provided on both sides of the cam.

* * * * *